US005991506A

United States Patent [19]

Platsch

[11] Patent Number: 5,991,506

[45] Date of Patent: Nov. 23, 1999

[54] DRYER UNIT

[75] Inventor: Hans G. Platsch, Stuttgart, Germany

[73] Assignee: Grafix Zerstaubungstechnik GmbH, Germany

[21] Appl. No.: 08/984,013

[22] Filed: Dec. 3, 1997

[30] Foreign Application Priority Data

Dec. 10, 1996 [DE] Germany ..... 196 51 301

[51] Int. Cl.[6] ..... A61H 33/08

[52] U.S. Cl. ..... 392/379; 392/407; 392/423; 392/380

[58] Field of Search ..... 392/379, 382, 392/407, 423, 380; 219/388, 400, 385, 386; 34/524, 550

[56] References Cited

U.S. PATENT DOCUMENTS

| | | | |
|---|---|---|---|
| 3,911,593 | 10/1975 | Colapinto | 34/572 |
| 4,185,912 | 1/1980 | Schwartz | 355/28 |
| 5,117,562 | 6/1992 | Dulay et al. | 34/550 |
| 5,134,788 | 8/1992 | Stibbe et al. | 34/524 |
| 5,214,442 | 5/1993 | Roller | 347/102 |
| 5,396,270 | 3/1995 | Gooray et al. | 346/25 |
| 5,587,730 | 12/1996 | Karz | 347/43 |
| 5,668,921 | 9/1997 | Essler | 392/379 |
| 5,776,306 | 7/1998 | Hepford | 162/112 |
| 5,864,728 | 1/1999 | Earle et al. | 396/615 |

*Primary Examiner*—Teresa Walberg
*Assistant Examiner*—Vinod D. Patel

[57] ABSTRACT

A dryer unit intended especially for drying printed products, has a frame in which two sides of the frame are formed by portions of profile material of the kind used also for the manufacture of rail main bodies of heating rails.

13 Claims, 13 Drawing Sheets

150
118
34
6
128'
136
132
114
122
124
22
110

DRYER UNIT

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The invention relates to a dryer unit having a plurality of heating rails, each of the rails having a main body which is a portion of an extruded hollow profile and which is connected to a heat source.

A dryer unit of that kind is described in German Patent DE 44 42 940 A1

In that dryer unit, the frame consists in practice of metal parts that are manufactured for every frame size and the particular use. For that reason, the frame is relatively expensive.

BRIEF SUMMARY OF THE INVENTION

The object of the present invention is to provide a dryer unit as described above in which the frame can be manufactured more cheaply. This object is achieved by a frame for carrying a plurality of heating rails, wherein the frame surrounds the heating rails, frame parts of which extending parallel to the heating rails being formed by portions of the same extruded hollow profile as the main bodies of the plurality of heating rails.

In the case of the dryer unit according to the invention, the frame sides extending parallel to the heating rails are formed by portions of a hollow profile of the kind used also for the manufacture of rail main bodies of the heating rails. It is therefore possible to use one and the same hollow profile material for various purposes, which has a favorable effect on stock-keeping and cost price. Since the hollow profile used has, in addition to a closed central channel, which is used as an air channel in the rail main bodies, further rib structures, the hollow profile has a high mechanical strength.

The orientation of the frame parts that are parallel to the heating rails, which the hollow profile has blowing ribs, and the blowing ribs lie on the outside of the frame parts that are parallel to the heating rails, is advantageous with regard to a high mechanical loading capacity of those frame parts: with that orientation, the blowing ribs carried by the hollow profile lie parallel to and spaced from the plane of the frame, with the result that a geometrical moment of inertia improved by the blowing ribs is obtained against bending.

With the development of the invention in which the blowing ribs of the lateral frame parts are provided with blowing air channels, on the one hand standard hollow profile portions can be used optionally as rail main bodies and as frame parts that are parallel to the heating rails. Furthermore, air can additionally be blown out of the frame parts that are parallel to the heating rails, which improves the drying of, say, printed sheets or coated plates, promotes the removal of used drying air and contributes to the cooling of the mechanical parts of the dryer unit.

With the development of the invention in which at least one of the frame parts that extend transversely to the heating rails is formed by wall plates one of which, which is towards the heating rails and the lateral frame parts, is provided with openings which are in communication with longitudinal channels of the heating rails and preferably also of the lateral frame parts and the end faces of the lateral frame part that is transverse to the heating rails are closed by end pieces which are portions of an endless profile that has a substantially U-shaped cross-section, wherein the open side of the U points towards the inside of the said frame part and the end pieces lie between end portions of the said wall plates of the frame part that extends transversely to the heating rails, a distributing box transverse to the heating rails is formed in a simple manner, by means of which the air channels provided in the rail bodies can be connected to a source of air in like manner. In that case—if desired—the frame parts located at the edges and parallel to the heating rails can also be coupled to the distributing chamber in terms of flow.

In that case, in which the endless profile has, integrally formed on at least one and preferably both of its arms receptacles each for one end of wall plates that lie parallel to the plane of the frame, wall plates can be positioned at and fastened to the end-face parts of that distributing chamber in a simple manner, which wall plates extend parallel to and spaced from the plane of the frame and form the lower and the upper boundary wall of the distributing chamber.

In accordance with the invention, in which the wall plates that extend parallel to the plane of the frame are formed by wall plate segments which are provided at a first end with a receptacle which is complementary to the second end, lying opposite the first end, of the wall plate segments, a distributing chamber of varying length can be constructed simply by using wall plate segments of standard size.

The development of the invention in which the wall plate segments are portions of an extruded profile rail, is again advantageous with regard to low production costs of the wall plate segments with high dimensional accuracy. The high dimensional accuracy is advantageous with regard to substantially air-tight assembly of a wall plate from wall plate segments without additional sealing measures.

The development of the invention in which the wall segments preferably have fastening bores located at one of their ends, allows the wall plate segments to be connected to the wall plates of the distributing channel that extend perpendicular to the plane of the frame in a simple manner and without additional mechanical treatment of the wall plate segments.

In accordance the invention the wall plate that is adjacent to the ends of the heating rails and perpendicular to the plane of the frame has bores for fastening means by which the heating rails can be connected to that wall plate, a precise alignment of the heating rails and of the parts of the frame that are parallel thereto is obtained in a simple manner at low cost.

The development of the invention in which heating rails carrying IR radiator elements and hot air heating rails have the same pattern of fastening bores in their end faces, allows a frame to be fitted optionally entirely with heating rails carrying IR radiator elements (infrared heating strips) or entirely with hot air heating rails or with a mixture thereof The type of heating rails fitted can also be changed at the place of use according to requirements.

The development of the invention in which at least some of the heating rails are fastened to the frame parts that are transverse to the heating rails by means of hollow adapter pieces that cause those heating rails to be offset in a direction perpendicular to the plane of the frame, allows the heating rails of a dryer unit to be arranged at different distances from a reference surface (as the rule the transport surface of the products to be dried). This makes it possible, in particular, to specify a different distance from the reference surface for heating rails that carry IR radiator elements and for hot air heating rails. It is also possible in that manner, however, to arrange heating strips of the same kind at different distances from the transport plane along the transport part of the products past the dryer unit and thus carry out gentle drying initially and intense residual drying in the last part of the transport path.

If, in accordance with the invention the profile materials are extruded from aluminum, aluminum is used for the various extruded profile materials, then the parts made therefrom are distinguished by good heat conduction and high mechanical loading capacity, especially also insensitivity to impact and fatigue fracture. Those profile materials can also be manufactured at especially favorable cost.

The development of the invention in which the frame parts that extend parallel to the heating rails are cut to length from a hollow profile having two blowing ribs and the space between the blowing ribs serves as a cable channel is advantageous with regard to clear and compact laying of electrical lines to the dryer unit (e.g. to heating cartridges or IR radiator elements carried by the dryer unit).

BRIEF DESCRIPTION OF SEVERAL VIEWS OF THE DRAWINGS

The invention is described in detail below with the aid of illustrative embodiments with reference to the drawings, in which.

DETAILED DESCRIPTION OF THE INVENTION

Figure 1:
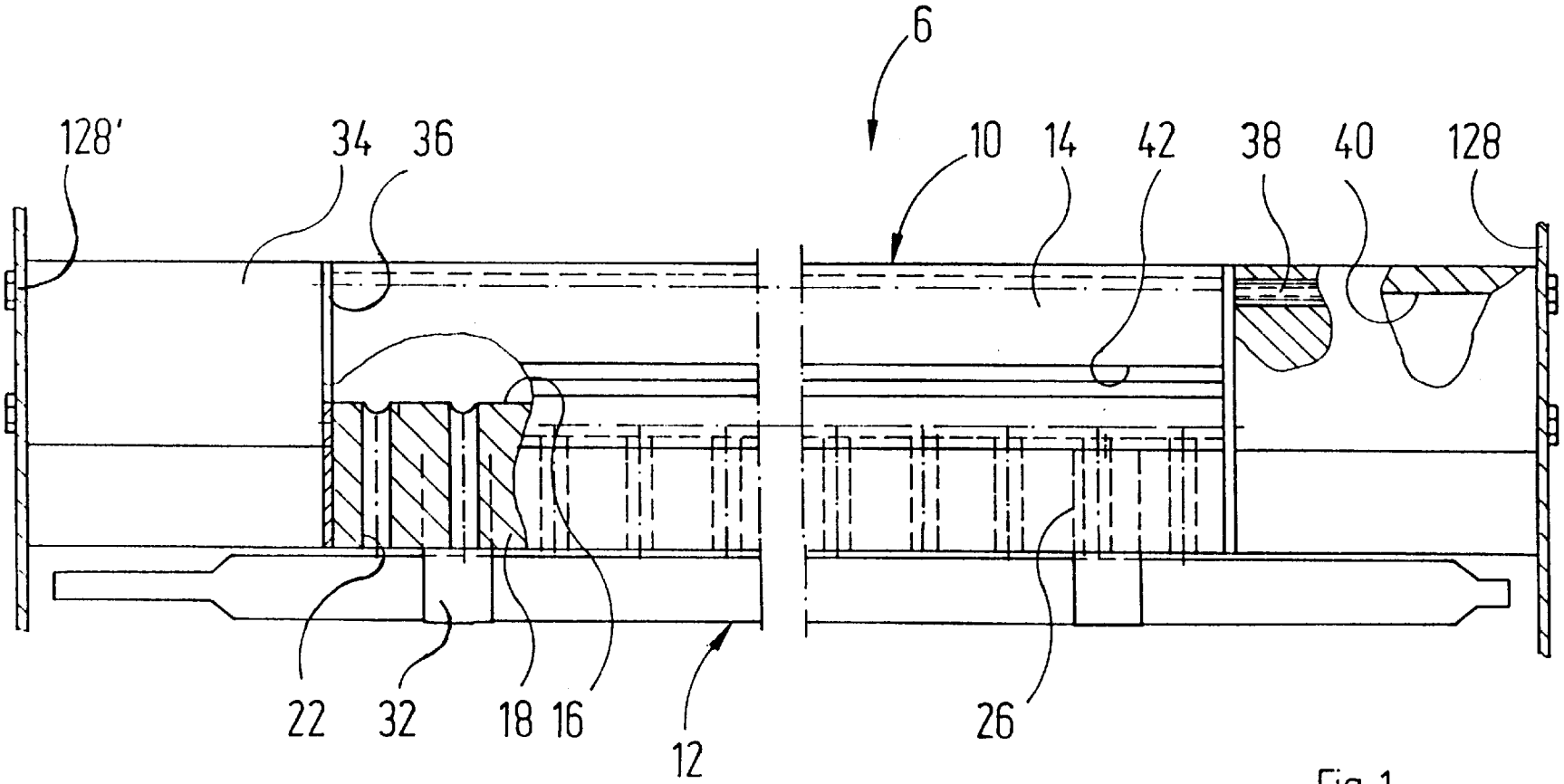
FIG. 1: is a side view of an infrared heating rail for use in a dryer for a printing machine, partly in section in different planes.
Figure 2:
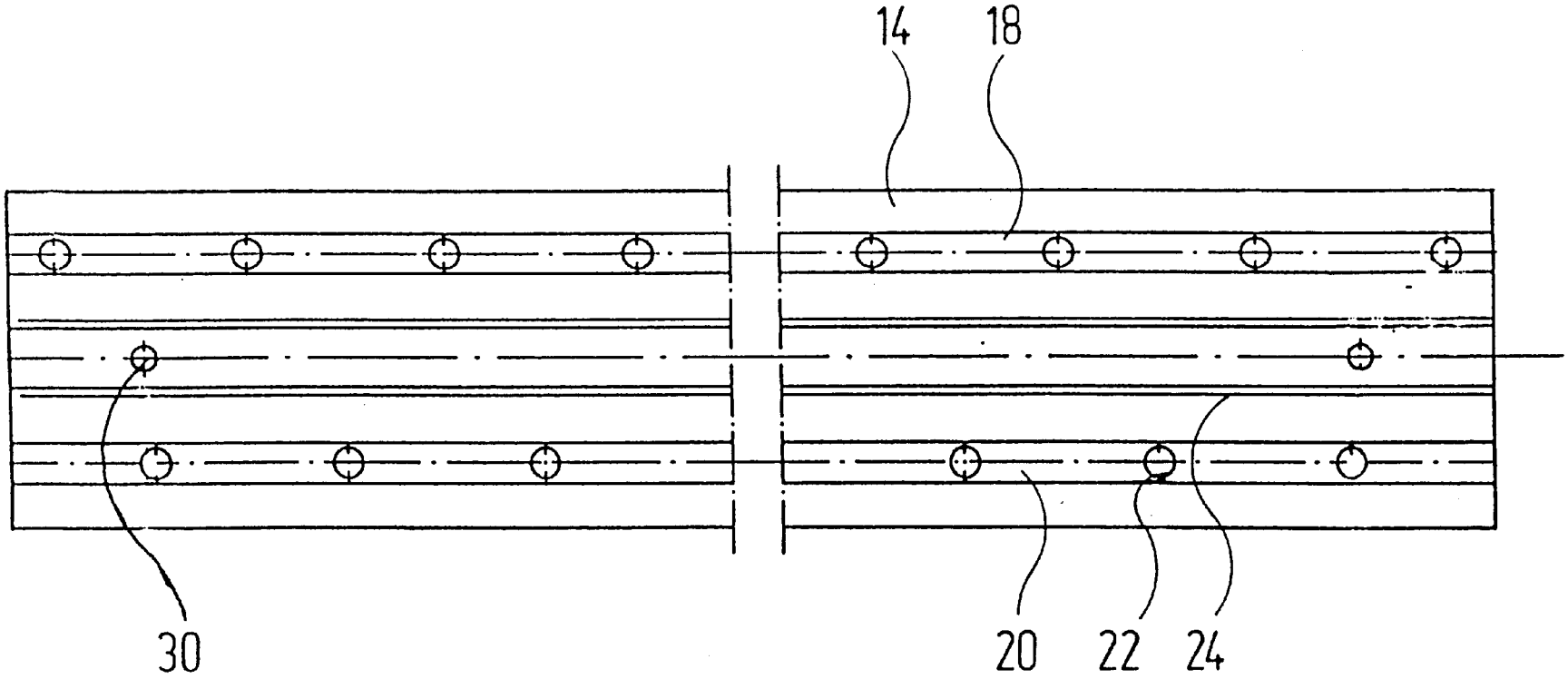
FIG. 2: is a plan view of the underside of a rail main body of the heating strip shown in FIG. 1.
Figure 3:
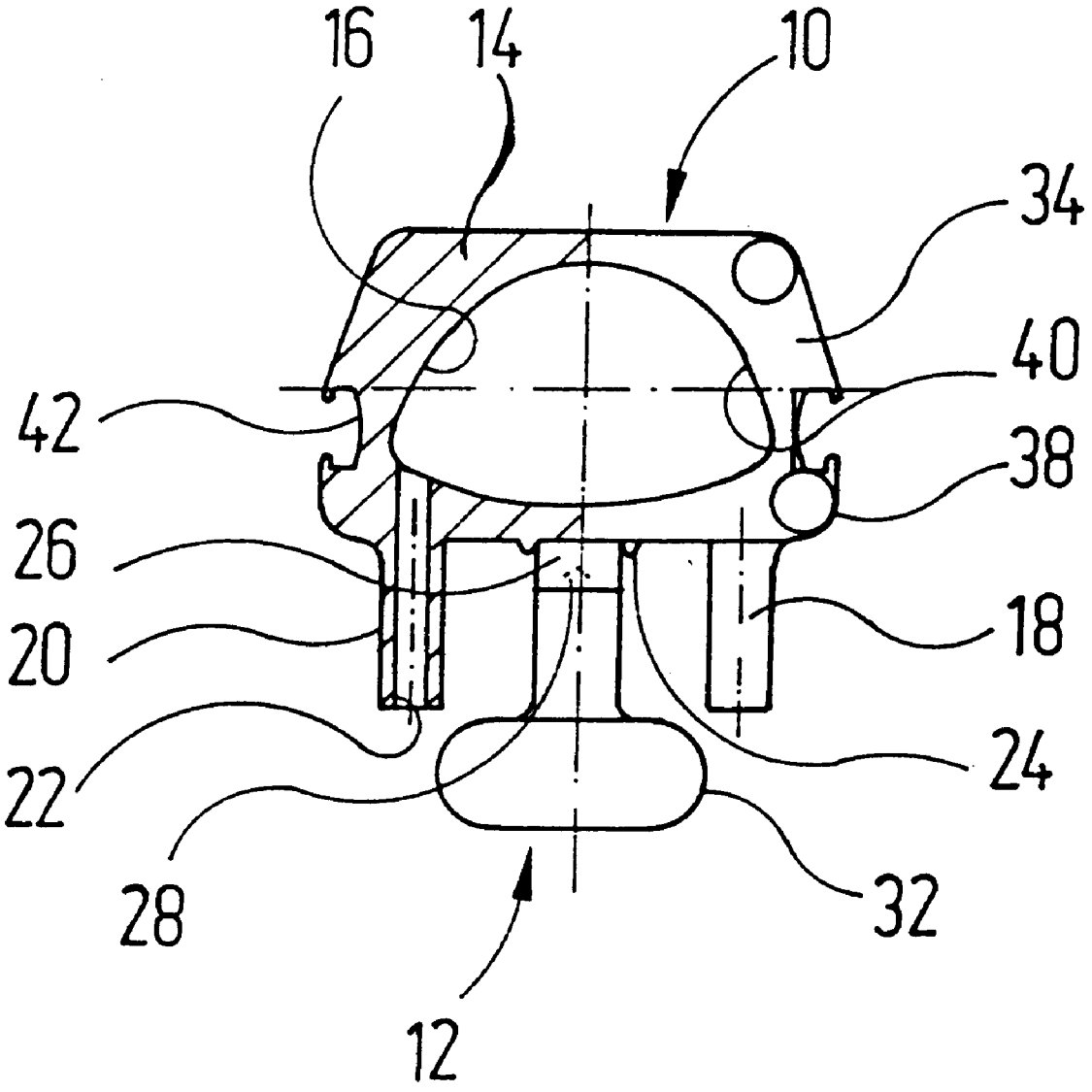
FIG. 3: is a plan view of one end face of the heating rail shown in FIG. 1.

In FIGS. 1–3, an infrared heating rail 6 is shown which has a housing, designated 10 in its entirety, which carries an IR radiator rod 12.

The housing 10 has a rail main body 14 obtained by cutting to length an extruded endless profile of aluminum or an aluminum alloy. The endless profile has a central air channel 16. Integrally formed on that plane boundary surface of the rail main body 14 which is at the bottom in FIG. 1 are two parallel blowing channel ribs 18, 20 which extend in the longitudinal direction and into which blowing channels 22 have been drilled at regular intervals using a drilling tool, the upper ends of which blowing channels open into the air channel 16.

Between the blowing channel ribs 18, 20, two lower positioning ribs 24 are integrally formed on the lower boundary surface of the rail main body 14 between which positioning ribs 24 there are seated at the two ends of the rail main body 14 two holding blocks 26 which are screwed by screws 28 to threaded bores 30 provided between the positioning ribs 24 in the end portions of the housing main body 24. The holding blocks 26 each carry two holding springs 32 which, with their U-shaped end portions facing each other, each grip around one of the sides of the oval cross-section radiator rod 12.

The end faces of the rail main body 14 are connected to adapter parts 34, a flat seal 36 of silicone rubber being arranged between each of the latter and the end face of the rail main body 14. The adapter parts 34 are detachably connected to the housing main body 14 by means of screws 38 and each has an air channel 40 integrally formed therein which can be connected to a source of blowing air not shown.

At the two side faces, holding grooves 42 are integrally formed on the rail main body 14, which serve to receive a nut or a screw head so that further components, for example cover plates, can be screwed on at the sides of the rail main body if required.

Figure 4:
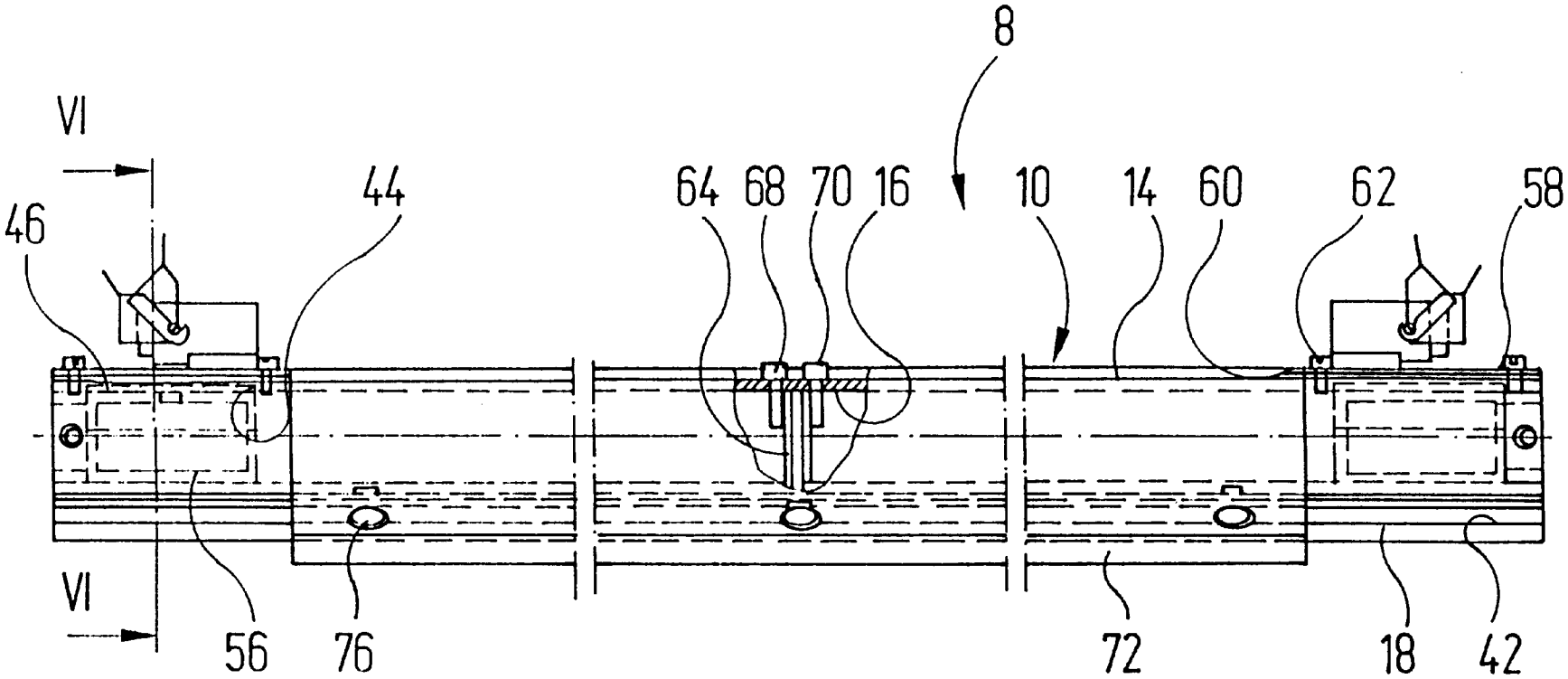
FIG. 4: is a side view of a hot air heating rail for use in a dryer for a printing machine, partly in section.

In FIG. 4, a hot air heating rail 8 is shown which is constructed according to a similar principle to the infrared heating rail shown in FIGS. 1–3. Functionally equivalent main components of the rail are again provided with the same reference numerals and will not be described again in detail even if they differ from the first illustrative embodiment in constructional details.

The extruded profile of aluminum or an aluminum alloy from which the rail main body 14 is made has, when viewed in transverse section, the shape of a rectangle with a triangle added at the bottom. At the lowest point of the rail main body, a single blowing channel rib 18 is integrally formed on, having a holding groove 42 integrally formed therein on both sides.

Cut into the upper side of the rail main body are two substantially rectangular windows 44 and, into these, wall segments 46 are inserted which ensure a smooth continuation of both the air channel 16 and the outer surface of the housing. For that purpose, the wall segments 46 have an inner surface 48 which is curved in conformity with the air channel 16, and a flat outer surface 50. A cable groove 52 is cut into the outer surface 50, which leads to a cable bore 54 which opens towards the inner surface 48.

There extend through the cable bore 54 and the cable groove 52 the connection leads, not shown in the drawing, for a heating cartridge 56 which may have a construction similar to that known from hot air fans for drying hair. The heating cartridges 56 are fastened to the wall segments 46, for example are glued thereto. Arranged above each wall segment 46 inserted in the strip main body 14 is a flat seal 58 of silicone rubber, and over the latter lies an outer cover plate 60 which is connected to the rail main body 14 by means of screws 62.

Arranged in the middle of the rail main body 14 is a blocking disc 64 the outer contour of which corresponds to the cross-sectional contour of the air channel 16 and which is positioned axially by two screws 68, 70 which overlap its faces.

Figure 6:
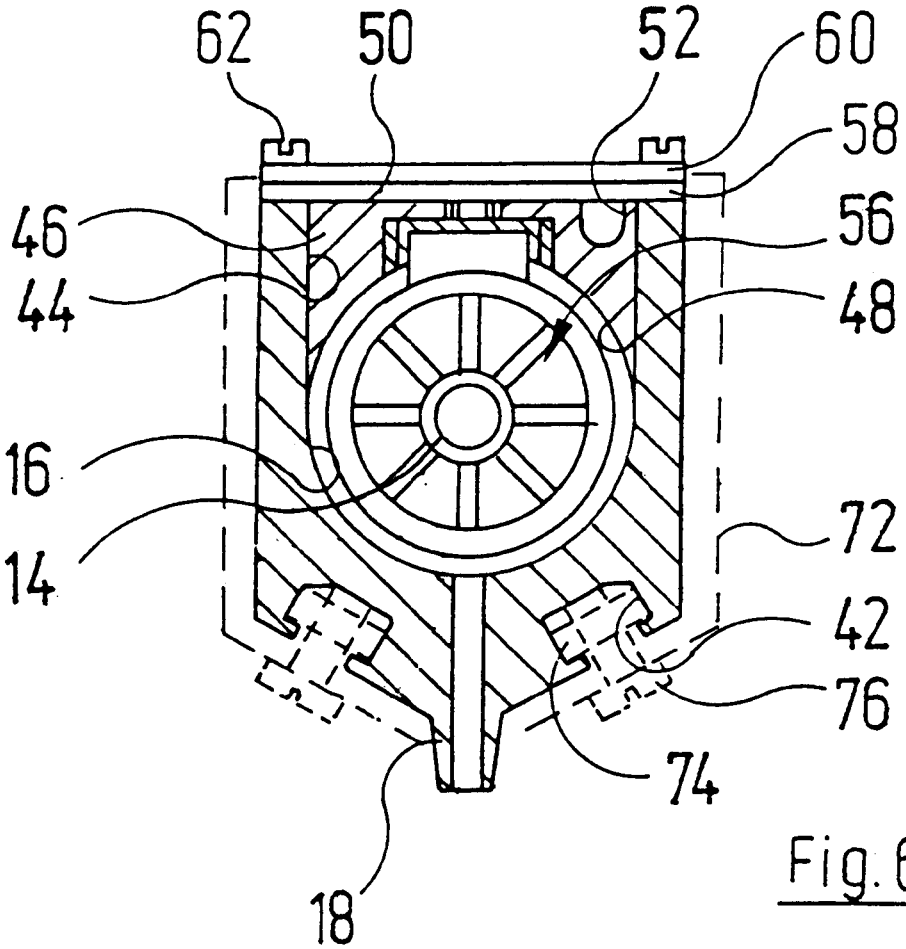
FIG. 6: is a transverse section through the heating rail shown in FIG. 4, along the line of section VI—VI therein.

As indicated in FIG. 6 by broken lines, an outer housing 72, which is bent from sheet metal, surrounds the outer surfaces of the strip main body 14 with clearance and is connected to the strip main body 14 by nuts 74 which are held displaceably in the holding grooves 42 and by bolts 76 which cooperate with the nuts 74.

Figure 7:
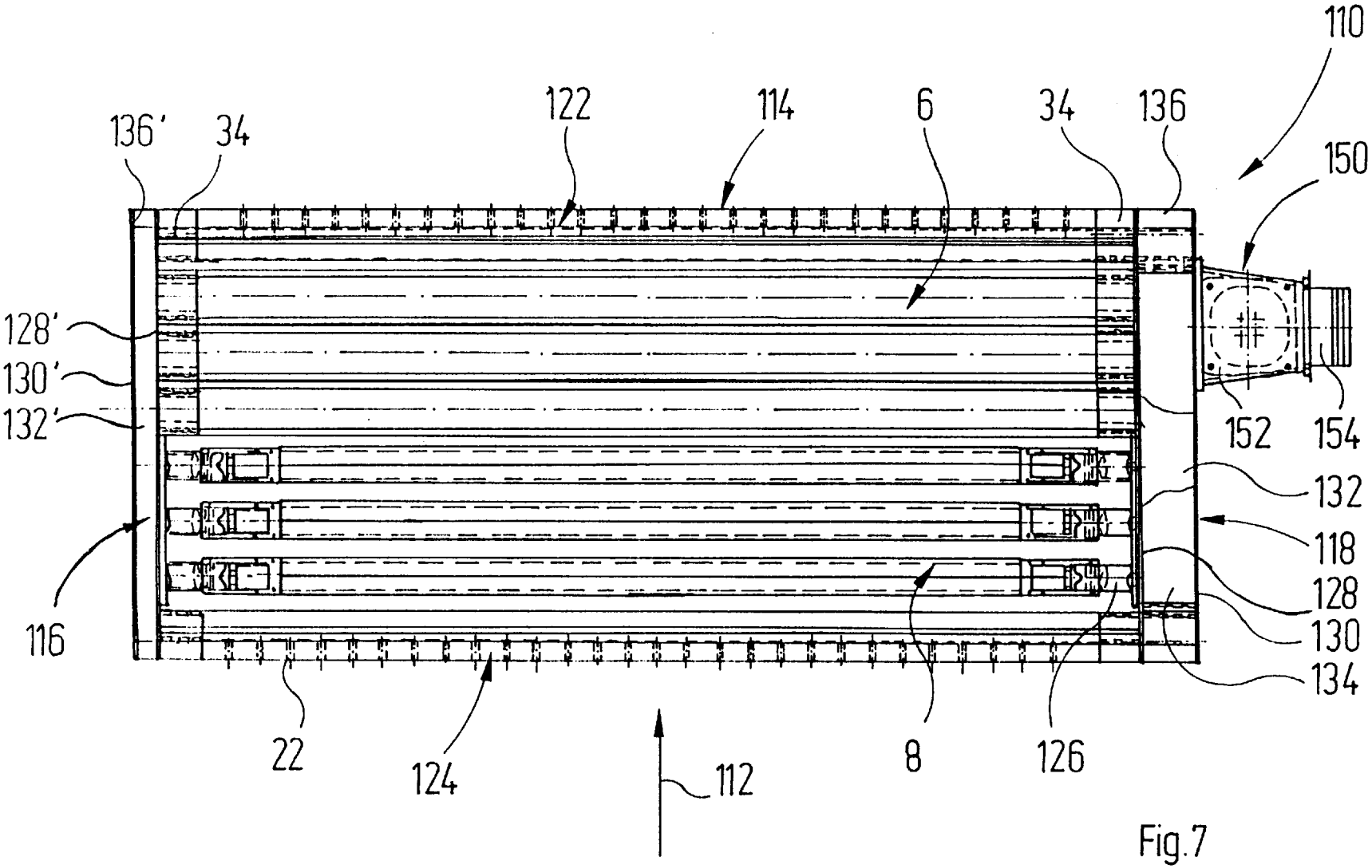
FIG. 7: is a plan view of a dryer unit fitted both with hot air heating rails and with IR heating rails.
Figure 8:
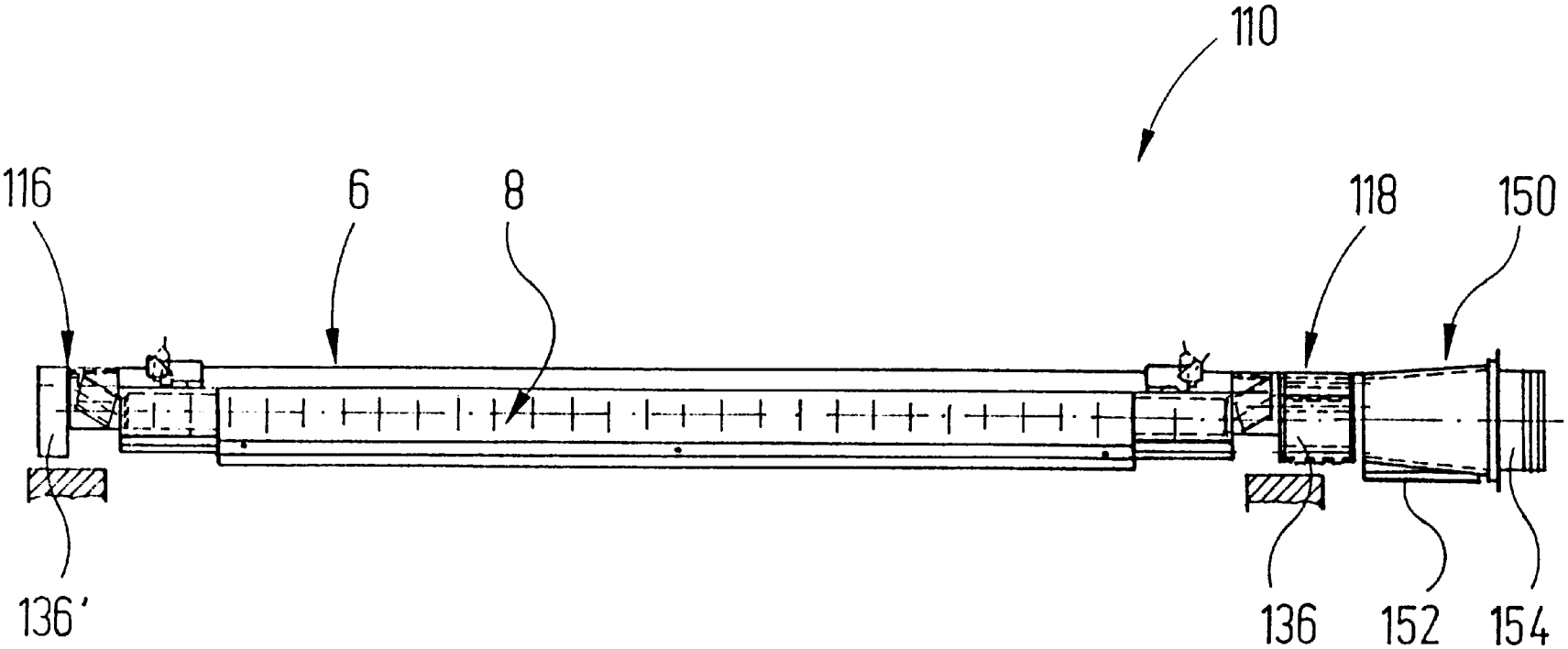
FIG. 8: is a side view of the dryer unit shown in FIG. 7.

In FIG. 7, a dryer unit intended for drying printing inks and/or printing lakes in a multi-color printing machine (for intermediate drying or final drying) is designated 110 in its entirety. The transport path of the printed products is indicated by an arrow 112. In practice, a plurality of dryer units 110 can be arranged in succession along the transport path of the printed products. In that case, those dryer units can be equipped first with hot air heating rails and, in a later section of the transport path, with IR heating rails so as first to volatilize the majority of the liquid to be removed and subsequently to carry out residual drying.

Figure 5:
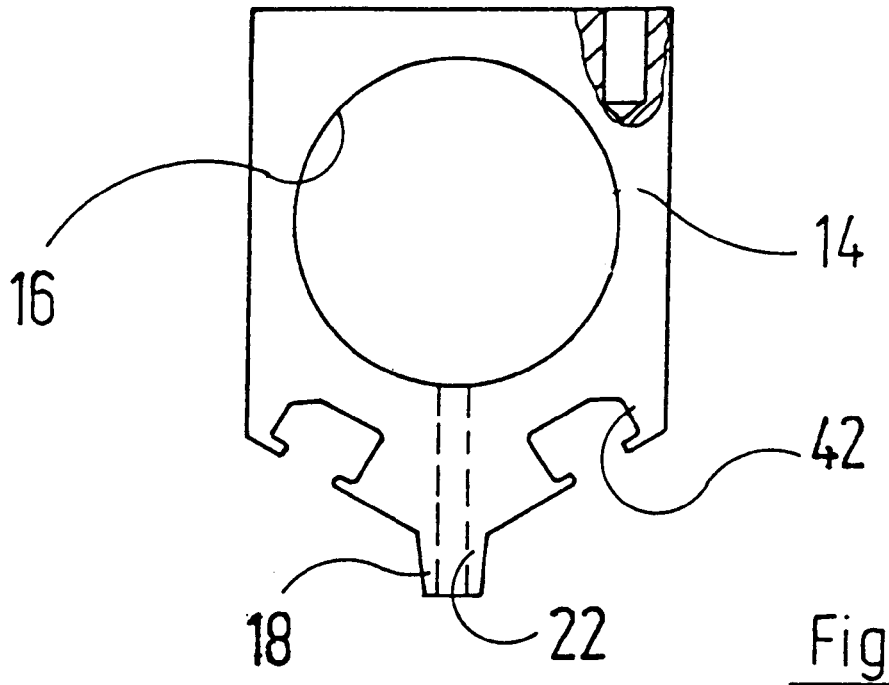
FIG. 5: is a plan view of the end face of a housing main body of the heating strip according to FIG. 4.

In the case of the dryer unit shown in FIG. 7, which can be used, for example, as an intermediate dryer unit between successive printing stations of a printing machine, an upstream portion is equipped with hot air heating rails 8 of the kind described above with reference to FIGS. 4 to 6, and a downstream portion is equipped with IR heating rails 6 of the kind described above with reference to FIGS. 1 to 3.

The heating rails 6 and 8 are carried by a frame designated 114 in its entirety.

The frame 114 has, on the left in FIG. 7, a hollow frame part 116 and, on the right in FIG. 7, a lateral frame part 118 which is likewise hollow and which forms an air distributing channel 120. Frame parts 122, 124 that are parallel to the heating rails 6, 8 connect the frame parts 116, 118 to form a rigid frame. The frame parts 122, 124 are manufactured from the same hollow profile material as is used also for the manufacture of rail main bodies. In the illustrative embodiment under consideration here, the rail body profile used for the IR heating rails of the kind shown in FIG. 3 is used for the frame parts 122, 124. Owing to the eccentric blowing ribs 18, 20, that profile is distinguished by especially high strength at low weight.

As will be seen from the drawing, the IR heating rails 6 are connected to the frame parts 116 and 118 by means of adapter parts 34. Identical adapter parts 34 are also situated between the ends of the frame parts 122, 124 and the frame parts 116 and 118. The frame parts 122, 124 also are constructed to have blowing channels 22. The same profile portions can therefore be used optionally as the rail main body for IR heating rails or as the frame part 122 or 124.

The frame part 118 consists of two lateral wall plates, that is to say two wall plates extending parallel to the transport direction 112 and perpendicular to the axes of the heating rails, namely an inside wall plate 128 and an outside wall plate 130. There also belong to the frame part 118 a segmented lower wall plate 132 and a segmented upper wall plate 134, only part of the latter being shown in FIG. 7. The ends of the frame part 118 are closed by end pieces 136 which are sandwiched in a sealed manner between the wall plates 128 and 130.

As can be seen from FIG. 7, the frame parts 122, 124 are turned through +/−90° relative to the heating strip bodies of the IR heating rails 6, so that their blowing ribs 18, 20 point towards the outside of the frame and are parallel to the plane of the frame.

Figure 9:
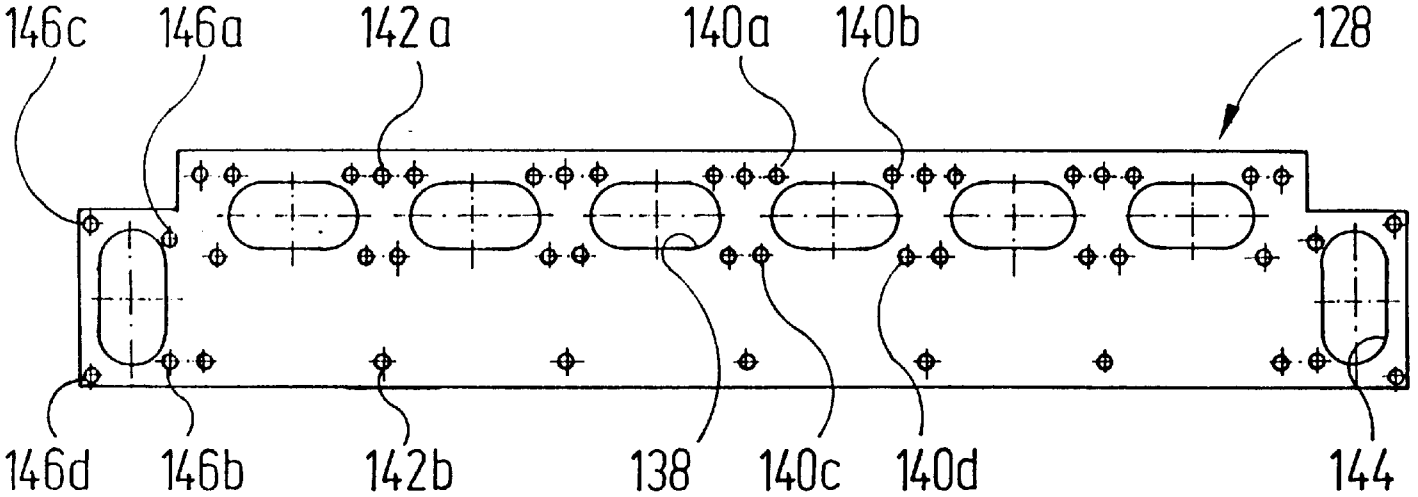
FIG. 9: is a plan view of the inside wall plate of a distributing channel of the dryer unit shown in FIG. 1.
Figure 10:
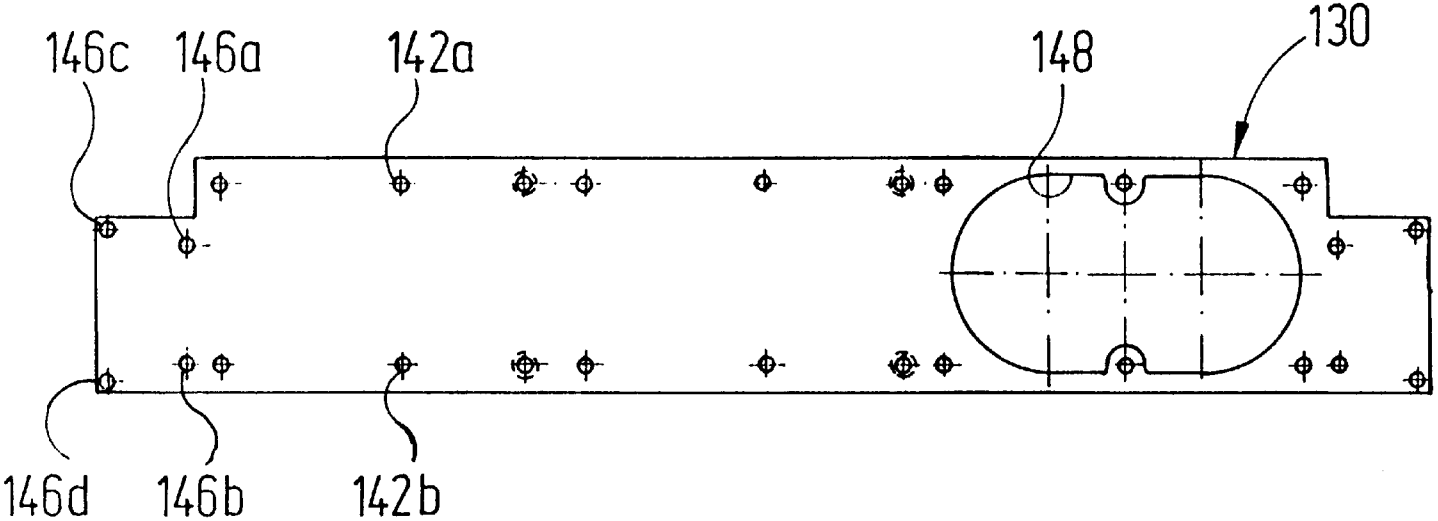
FIG. 10: is a plan view of an outside wall plate which, together with the wall plate shown in FIG. 9, defines the distributing channel in the longitudinal direction.

As can be seen from FIG. 9, the wall plate 128 has openings 138 through which it is in communication with the longitudinal channels 16 of the IR heating rails 6 and of the hot air heating rails 8. The openings 138 are each surrounded by four through-holes 140*a*, 140*b*, 140*c*, 140*d* for fastening screws (not shown) which pass through the adapter pieces 34 and are screwed into the ends of the IR heating rails 6 or which are screwed to the adapter parts 126.

There is also provided for each heating rail a set of through-holes 142*a*, 142*b* which is used for the attachment of wall plate segments as will be described in more detail later.

The wall plate 128 has in its end portions openings 144 which correspond to the openings 138 in geometry but which are turned through 90° so that they are in alignment with the longitudinal channels of the frame parts 122, 124. The openings 144 are surrounded by through-holes 146*a*, 146*b*, 146*c* and 146*d* to which the frame parts 122, 124 are screwed.

The rear wall plate 128 is similarly provided with a pattern of through-holes corresponding to the through-holes 142 and 146. The rear wall plate 130 also has a large opening 148 which communicates with a connection part 150 (compare FIG. 7).

The connection part 150 comprises an axial connection opening and a connection opening pointing downward in the drawing, one of which openings (according to the particular conditions of use) is closed by a blind plate 152 while the other carries a connection pipe 154.

Figure 13:
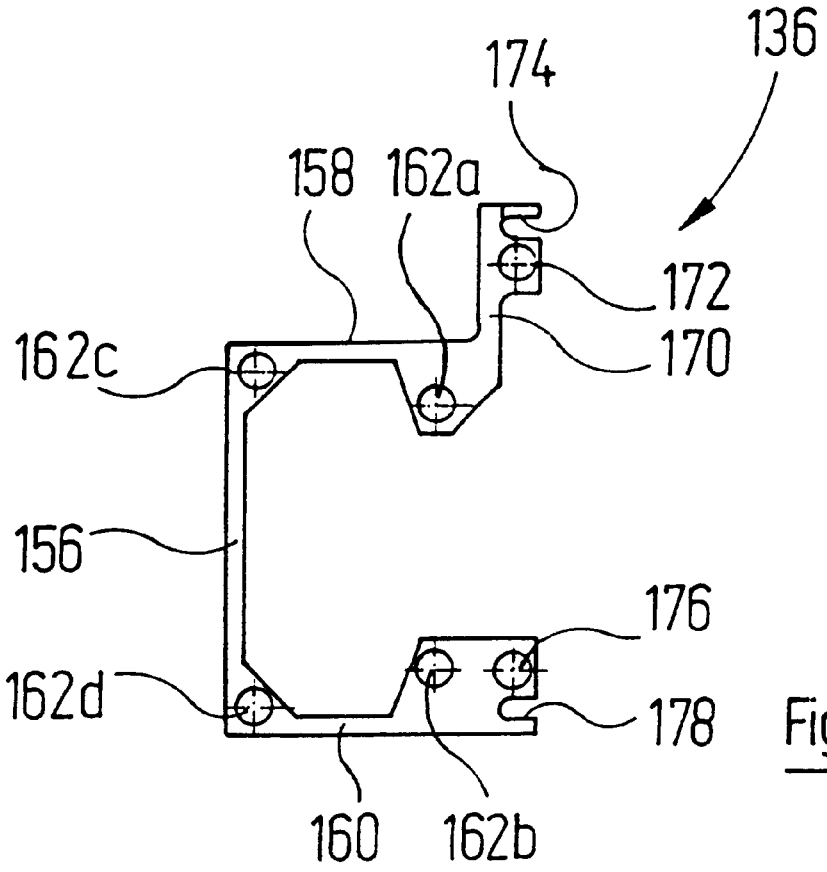
FIG. 13: is a plan view of the end face of a portion of a hollow profile used to close the ends of the distributing channel.

The end pieces 136 are made by cutting to length a hollow profile material having the cross-section shown in FIG. 13.

A lateral base portion 156 is connected to two arms 158, 160 which are horizontal in FIG. 13. The transition regions between the base portion 156 and the arms 158, 160 are triangular so that fastening bores 162*c* and 162*d* can be provided in them. Similar fastening bores 162*a*, 162*b* are located in thickened regions of the arms 158, 160. The position of the fastening bores 162 corresponds to the position of the through-holes 146. In that manner, the end pieces 136 can be connected to the wall plates 128 and 130 and, through the adapter parts 34, to the frame parts 122, 124 and tightened thereto by means of long screws, not shown.

From the arm 158 lying at the top, a piece 170 extends upward, in which a further fastening bore 172 and a receiving groove 174, which is horizontal in FIG. 13, are provided. A fastening bore 176 and a receiving groove 178 are similarly provided in the thickened end portion of the lower arm 160. By means of the fastening bores 172, 176, the spacing of which corresponds to the spacing between the through-holes 146*a* and 146*c* and 146*b* and 146*d*, the end pieces 136 can be additionally connected to the wall plates 128, 130.

The hollow frame part 216 which is on the left in FIG. 7 is of a similar construction to the frame part 218 except that the end pieces 136 are somewhat narrower.

If desired, however, the frame part 216 can be provided as an exact mirror image of the frame part 218, that is to say also with a second connection part. That alternative is especially suitable for dryer units that are fitted with hot air heating rails throughout.

Figures 11, 12:
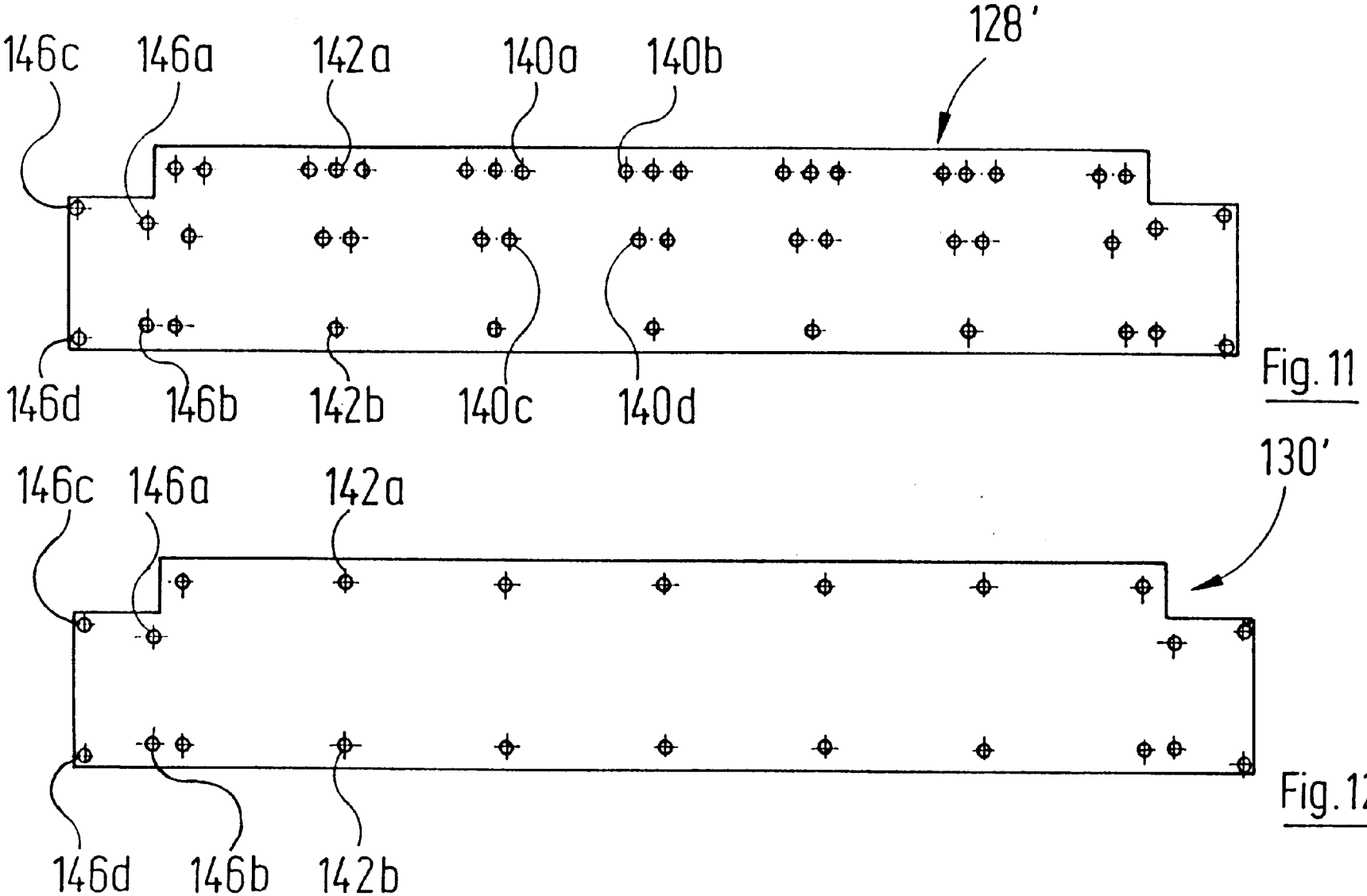
FIG. 11: is a plan view of an inside wall plate of a hollow lateral frame part of the dryer unit shown in FIG. 1.
FIG. 12: is a plan view of an outside wall plate which, together with the wall plate according to FIG. 11, defines the hollow frame part in the longitudinal direction.

As a further modification, the frame part 216 can also be given only a purely mechanically bearing function and be constructed in that case from wall plates 128' and 130' of the kind shown in FIGS. 11 and 12. The latter correspond in the pattern of the through-holes 140, 142, 146 to the wall plates 128 and 130 but do not have any openings 138, 144, 148, so that they close off the heating rails 6 and 8 and also the frame parts 122, 124 at the adjacent end. That alternative is suitable for purely IR dryer units.

The lower wall plate 132 and the upper wall plate 134 consist of individual interlocking wall plate segments 180 (compare FIGS. 14 and 15) which are made by cutting to length an extruded aluminum profile.

Figure 14:
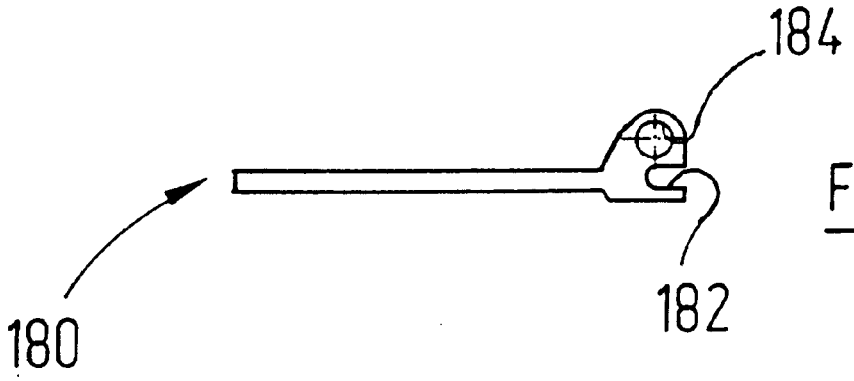
FIG. 14: is a side view of a wall plate segment in an orientation used to form a lower distributing channel wall plate.
Figure 15:
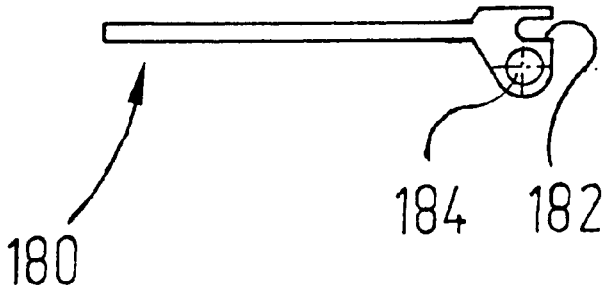
FIG. 15: is a side view of a wall plate segment in an orientation used to form an upper distributing channel wall plate.

FIG. 14 shows an orientation of the wall plate segments that is used to form the lower wall plate 132. In FIG. 15, a wall plate segment which is identical but turned through 180° and which is used to form the upper wall plate 134 is shown.

In the assembled state, a narrow end portion of a wall plate segment 180, which end portion is on the left in FIGS. 14 and 15, engages in each case in a receiving groove 182 of the adjacent wall plate segment. There are further provided in the wall plate segments 180, in the vicinity of the receiving groove 182, fastening bores 184 by means of which the wall plate segments 180 can be screwed to the through-holes 142*a* and 142*b* of the wall plates 128, 130.

In that manner, dryer units 110 that differ in size in the transport direction 112 of the printed products can be obtained using wall plates 128, 130 of differing lengths but otherwise using the same standard components.

Figures 16, 17:
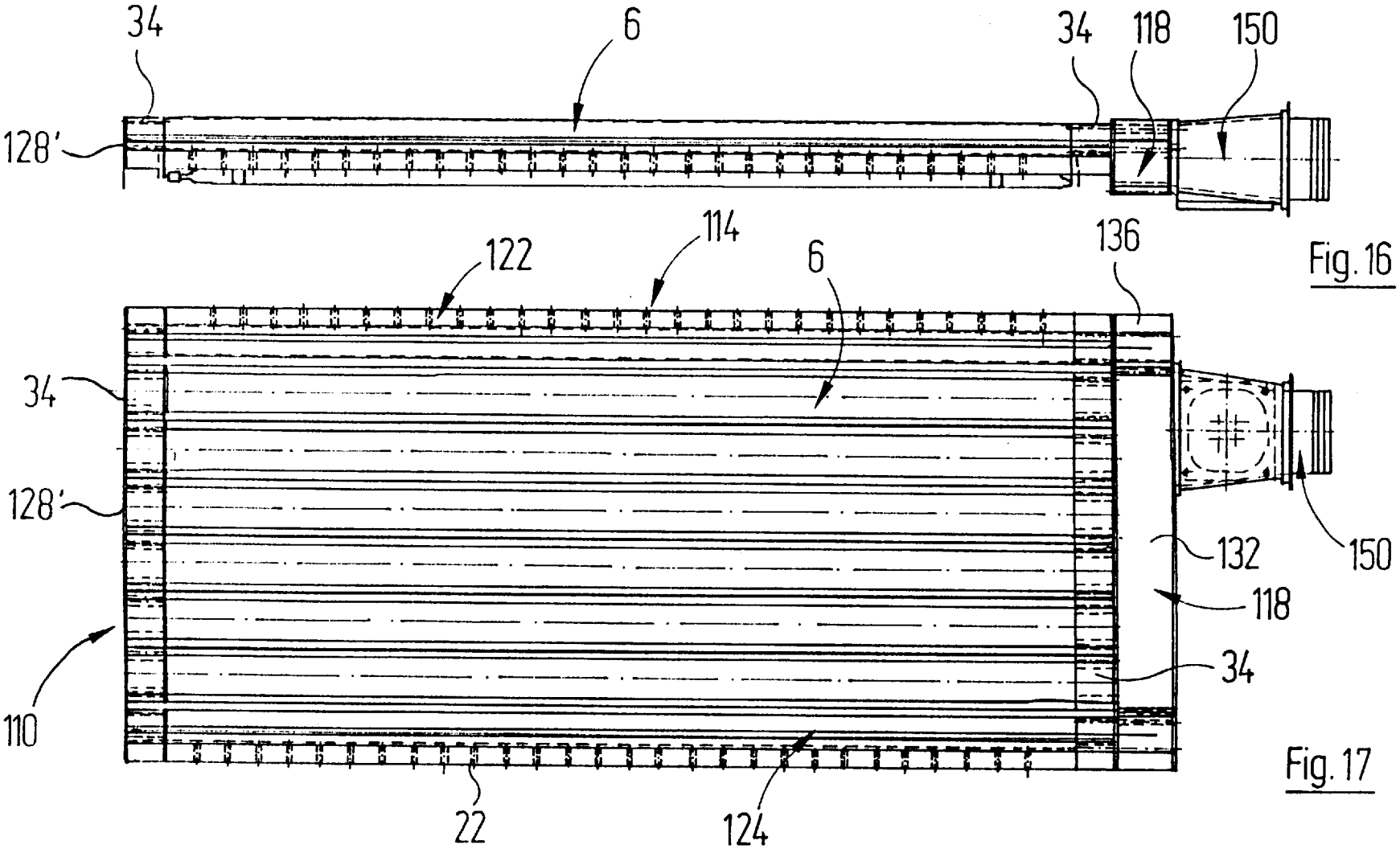
FIG. 16: shows a transverse central section through a modified dryer unit provided exclusively with IR heating rails.
FIG. 17: is a plan view of the dryer unit according to FIG. 16.

FIGS. 16 and 17 show how a dryer unit 110 fitted exclusively with IR heating rails 6 can be obtained using the same frame 114 as that described above. The left-hand frame part consists only of the wall plate 128'.

Figure 18:
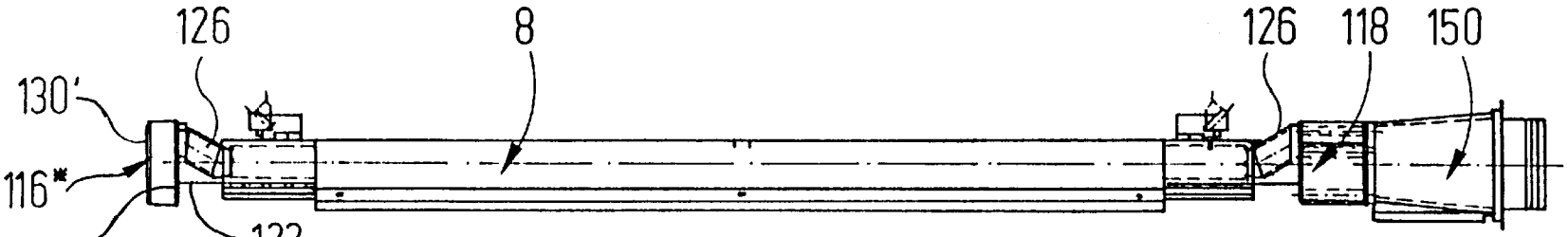
FIG. 18: shows a transverse central section through a dryer unit that is equipped exclusively with hot air heating rails.
Figure 19:
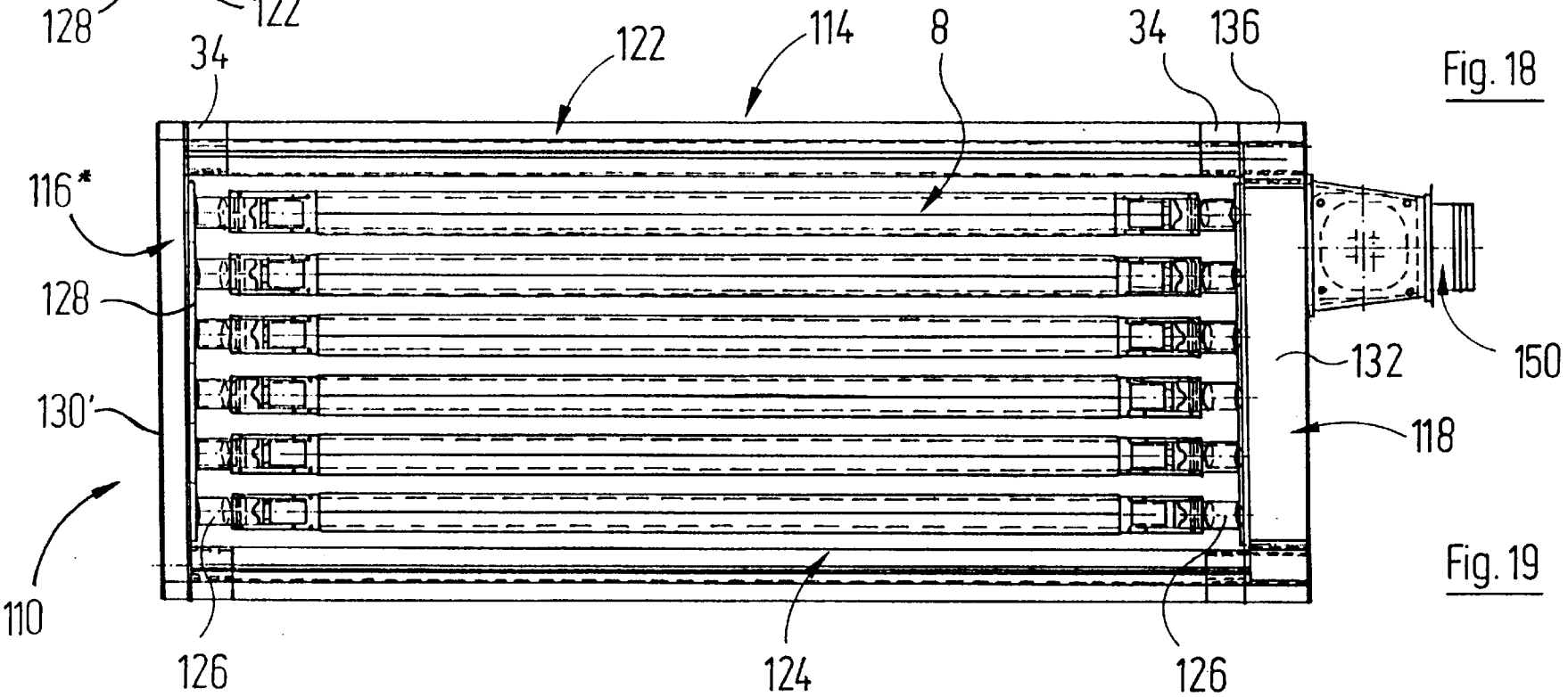
FIG. 19: is a plan view of the dryer unit shown in FIG. 18.

FIGS. 18 and 19 show a frame 114 of the kind described above fitted exclusively with hot air heating rails 8. The left-hand frame part 116* comprises a wall plate 128 and a wall plate 130'. The frame parts 122 and 124 are constructed without blowing channels 22. Air is therefore supplied to those ends of the heating rails 8 which are on the left in the drawing from the frame part 118 via the frame parts 122 and 124 and the frame part 116*, and only one connection part 150 is needed, which simplifies installation in the printing machine. If an exactly symmetrical admission of air to the heating rails 8 is desired, the frame part 116 will be constructed as an exact mirror image of the frame part 116 and the supply of air to the left-hand ends of the heating elements 8 will then be effected via the second connection part 150 of the frame part 116.

Figure 20:
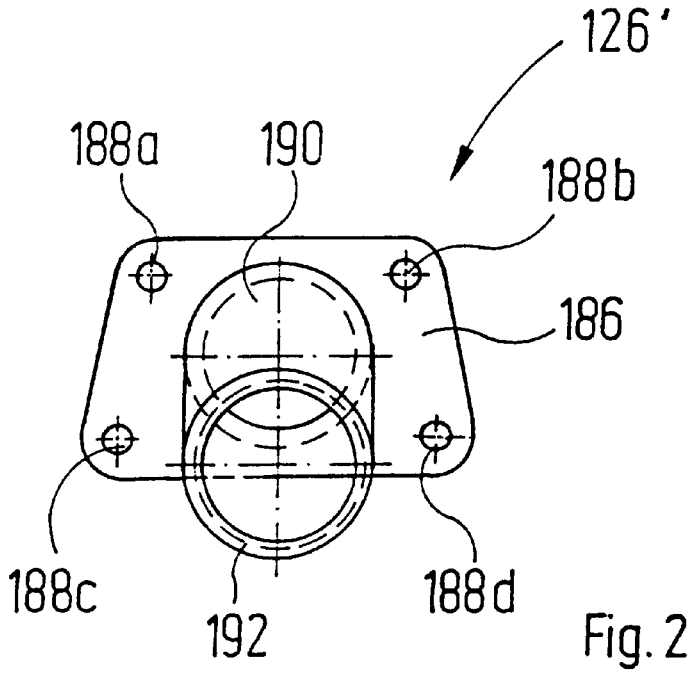
FIG. 20: is a plan view of one side of an adapter piece for attaching hot air heating rails to the distributing channel of the dryer unit according to FIG. 7, which side is on the inside in the installed state.
Figure 21:
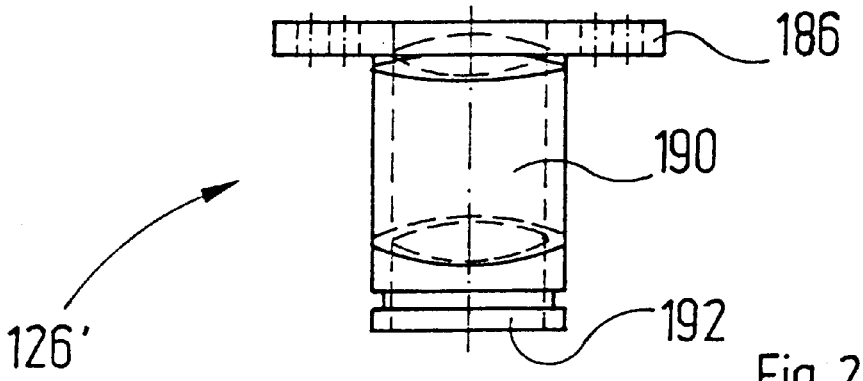
FIG. 21: is a plan view of the adapter piece shown in FIG. 20.
Figure 22:
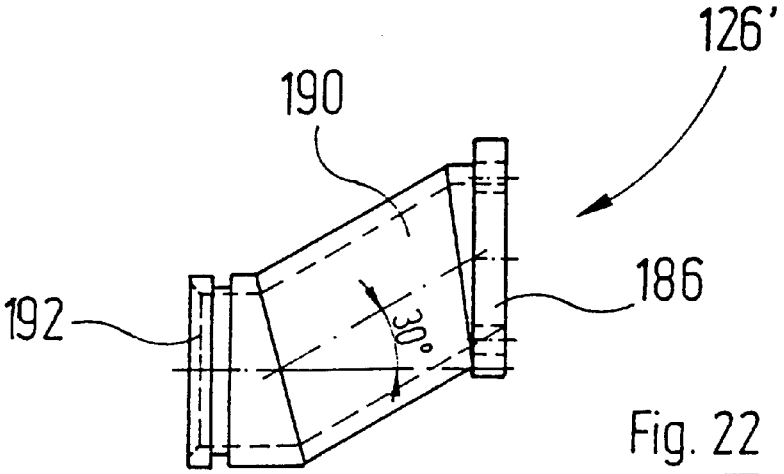
FIG. 22: is a side view of the adapter piece shown in FIG. 20.

As can be seen especially from FIG. 7, the hot air heating rails 8 are arranged closer to the transport plane of the printed products than are the IR heating rails 6. This is done by connecting the hot air heating rails 8 to the lateral frame parts 116, 118 by means of the adapter parts 126 which are different from the adapter parts 34 and which are shown in more detail in FIGS. 20 to 22.

The adapter parts 126 each have a flange plate 186 which is provided with through-holes 188*a*, 188*b*, 188*c*, 188*d* the position of which corresponds to that of the through-holes 142*a*, 142*b*, 142*c* and 142*d*.

The flange plate 186 carries a double-cranked tubular transition piece 190 having a free end portion 192 which fits into the longitudinal channel 16 of the hot air heating rails 8.

By using different adapter parts 126 in which the chosen angle of inclination of the transition piece 190, which is given as 30° in the drawing, is smaller or greater, it is also possible to select different spacings of the various hot air heating rails 8 from a flat transport surface of the products. Conversely, if the transport surface of the printed products is curved, the ends of the blowing channels 22 of successive heating rails can be set at different positions to conform to the curvature of the transport surface.

Adapter parts similar to the adapter parts 126 can also be used in conjunction with the IR heating rails 6, a second flange plate corresponding to the flange plate 186 then being fitted to the second end of the transition piece 190.

I claim:

1. A dryer unit having, a plurality of heating rails, each of said heating rails having a main body which is a portion of an extruded hollow profile and which is connected to a heat source, and a frame for carrying said plurality of heating rails wherein said frame surrounds said heating rails, and has frame parts that extend parallel to said heating rails being formed by portions of a same extruded hollow profile as said main bodies of said plurality of heating rails.

2. A dryer unit according to claim 1, wherein the hollow profile has blowing ribs and the blowing ribs lie on the outside of the frame parts that are parallel to the heating rails.

3. A dryer unit according to claim 2, wherein the blowing ribs of the lateral frame parts are provided with blowing air channels.

4. A dryer unit according to claim 1, wherein at least one of the frame parts that extend transversely to the heating rails is formed by wall plates one of which, which towards the heating rails and the lateral frame parts, is provided with openings which are in communication with longitudinal channels of the heating rails and also of the lateral frame parts, and the end faces of the lateral frame part that is transverse to the heating rails are closed by end pieces which are portions of an endless profile that has a substantially U-shaped cross-section, wherein the open side of the U points towards the inside of said frame part, and the end pieces lie between end portions of said wall plates of the frame part that extends transversely to the heating rails.

5. A dryer unit according to claim 4, wherein the endless profile has, integrally formed on both of its arms, receptacles each for one end of wall plates that lie parallel to the plane of the frame.

6. A dryer unit according to claim 5, wherein the wall plates that extend parallel to the plane of the frame are formed by wall plate segments which are provided at a first end with a receptacle which is complementary to the second end, lying opposite the first end, of the wall plate segments.

7. A dryer unit according to claim 6, wherein the wall plate segments are portions of an extruded profile rail.

8. A dryer unit according to claim 6, wherein the wall plate segments preferably have fastening bores located at one of their ends.

9. A dryer unit according to claim 4, wherein the wall plate that is adjacent to the ends of the heating rails and perpendicular to the plane of the frame has bores for fastening means by which the heating rails can be connected to that wall plate.

10. A dryer unit according to claim 9, wherein heating rails carrying IR radiator elements and hot air heating rails have the same pattern of fastening bores in their end faces.

11. A dryer unit according to claim 1, wherein at least some of the heating rails are fastened to the frame parts that are transverse to the heating rails by means of a hollow adapter pieces that cause those heating rails to be offset in a direction perpendicular to the plane of the frame.

12. A dryer unit according to claim 1, wherein the profile materials are extruded from aluminum.

13. A dryer unit according to claim 1, wherein the frame parts that extend parallel to the heating rails are cut to length from a hollow profile having two blowing ribs, and the space between the blowing ribs serves as a cable channel.

* * * * *